United States Patent [19]

Kühn

[11] Patent Number: 4,995,504

[45] Date of Patent: Feb. 26, 1991

[54] DEVICE FOR STRAIGHTENING ARTICLES SUCH AS LETTERS AND SIMILAR FLAT TRANSPORTED ARTICLES

[75] Inventor: Werner Kühn, Konstanz, Fed. Rep. of Germany

[73] Assignee: Licentia Patent-Verwaltungs GmbH, Frankfurt, Fed. Rep. of Germany

[21] Appl. No.: 117,240

[22] Filed: Nov. 4, 1987

[30] Foreign Application Priority Data

Mar. 24, 1987 [DE] Fed. Rep. of Germany ..... 3709659

[51] Int. Cl.[5] ..... B65G 47/24

[52] U.S. Cl. ..... 198/408; 198/457; 198/841; 271/251

[58] Field of Search ..... 198/456, 457, 394, 408, 198/604, 607, 837, 840, 841; 271/251; 193/2 D

[56] References Cited

U.S. PATENT DOCUMENTS 3,203,534 8/1965 Burkhardt et al. ..... 198/456
3,595,565 7/1971 Bergland ..... 271/251
4,432,686 2/1984 Feldkamper ..... 193/2 D

*Primary Examiner*—Joseph E. Valenza
*Attorney, Agent, or Firm*—McGlew & Tuttle

[57] ABSTRACT

As a device for straightening of letters and similar flat transported articles upon passage from a free wheeling section with a bottom conveyor belt to a cover belt section, whereby the letters are transported upright on a lengthwise edge and generally at the transition to the cover belt section are shifted in the vertical direction between the side belts of the free wheeling section by running against the bottom belt, a guide plate is provided at either side in the letter displacement zone, the plate has a step extending parallel in the direction of transport of the side belts and has a width equalling the thickness of a side belt, for the purpose of avoiding tearing of the letter flaps. The guide plates extend to the upper edge of the side belts and, by the flutter-free movement of the side belts, achieve a smooth sliding of the letters between the side belts.

4 Claims, 2 Drawing Sheets

DEVICE FOR STRAIGHTENING ARTICLES SUCH AS LETTERS AND SIMILAR FLAT TRANSPORTED ARTICLES

FIELD AND BACKGROUND OF THE INVENTION

Field of the Invention

This invention relates in general to feeding devices, and in particular to a new and useful device for straightening and feeding articles such as letters.

At mail distributing centers, letters of differing format are vertically transported between two conveyor belts of a so-called cover belt section. The pulling of the letters causes individual letters to twist upwards. In order to correct this effect, the letters pass through a free wheeling section.

In certain places in the mail distribution machines, the letters must be turned through 180° about their lengthwise axis. Whereas previously their lower lengthwise edges had been aligned, this is no longer the case after the letters are turned in a turning section, due to the different width of the letters. If they must afterwards be straightened once again, and especially if they enter an additional cover belt section at an angle from the free wheeling section with a bottom conveyor for collection and straightening of the letters, they will be shifted between the two side belts during the straightening and generally must alter their direction of transport in the vertical plane.

A single stage free wheeling section is necessary after a pulling mechanism, and a two-staged free wheeling section after a turning section. In these free wheeling sections, the letters are displaced between the side belts by the straightening. To enable such displacement without damage to thick letters, the distance between the side belts in the area of displacement of the letters is chosen such that thick letters can be adequately shifted. But thin letters slip down through the side belts and are prevented from falling out by guide plates mounted at the side between the bottom belt and the side belts. This known method with simple guide plates, however, has the serious disadvantage that improperly glued flaps of the letters can be ripped open or even torn off during the displacement of the letters between the conveyor belts.

SUMMARY OF THE INVENTION

The invention provides a device which obviates the aforesaid disadvantages. It should be possible to straighten the letters without damage after changes in direction of transport in the vertical plane.

An impact-free inner transition between side belt and guide plate and a flutter-free running of the side belts are achieved by special configuration of the guide plates with a step in the breadth of a side belt and extension of the guide plates at the outside to the upper edge of the side belts This prevents a ripping open or tearing off of flaps, both in event of the letters slipping down, and during their subsequent upward motion when straightened by the bottom belt. Furthermore, constant cleaning of the transitional zone and malfunctions caused by torn letter fragments getting stuck are avoided.

The modification of the invention has the advantage of maintaining operational security even during lengthy operating time and tolerance changes.

Accordingly, it is an object of the invention to provide an improved feeding device particularly for feeding letter articles such as letters which includes a bottom endless conveyor which has an upper reach over which the articles are moveable and free wheeling conveyor section which comprises a pair of conveyor belts arranged side by side and between which the article is supported, and which is moveable through a substantially vertical plane which extends toward the bottom conveyor and including a guide plate behind each conveyor belt which has a lower portion of a configuration and position such that it extends substanally up to the adjacent conveyor belt and parallel to the direction of movement of the free wheeling conveyor section and which has a width which equals substantially the thickness of the associated conveyor belt.

A further object of the invention is to provide a device for feeding articles which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
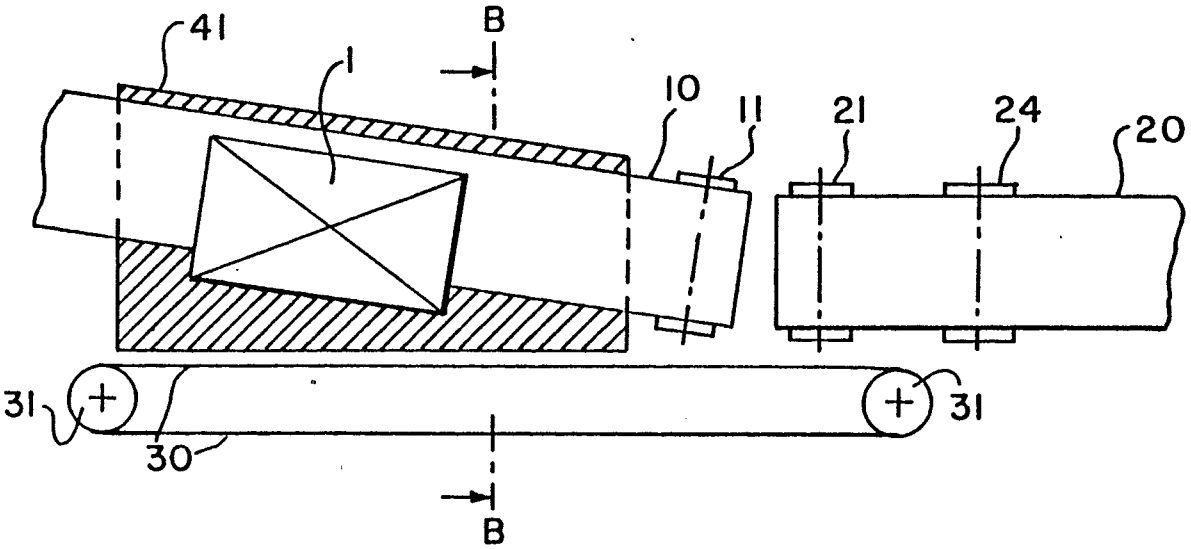
FIG. 1 is a partial sectional and elevational view taken along the line A—A of FIG. 2 of a device for feeding and straightening letters which is constructed in accordance with the invention.

Referring to the drawings in particular, the invention embodied therein comprises a device for straightening and feeding articles such as letters 1, for example in a mail handling station which comprises a bottom endless conveyor 30 having an upper reach over which the articles are moveable, and a free-wheeling conveyor section which comprises a pair of conveyor belts 10 and 13 disposed so that they are side by side for feeding the letter 1 there between, they are moveable through a substantially vertical plane which extends toward the bottom conveyor 30.

In accordance with the invention, a guide plate 41 and 42 is arranged behind each conveyor belt 30, and each plate 41 and 42 is a lower portion of a configuration and position such that it extends substantially up to the adjacent conveyor belt 13 and extends parallel to the direction of movement of the free-wheeling conveyor section. The plate 41 or 42 has a width substantially equal to the thickness of the associated conveyor belt.

Figure 2:
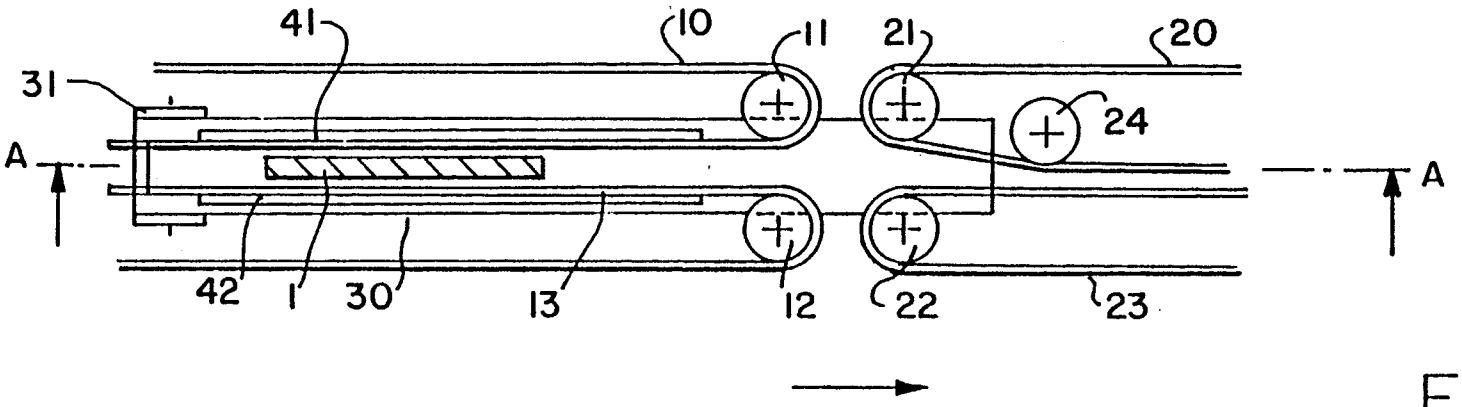
FIG. 2 is a top plan view of the device shown in FIG. 1.

The deflection rollers of the side belts 11 and 12, and the deflection rollers of the cover belts 20 and 30 of the cover belt section are designated 21, 22 and 24. The letters 1, as shown in FIG. 2, are conveyed by the side belts 10 and 13, travelling between the deflection rollers 11 and 12, and by the cover belts 20 and 23, travelling between the deflection rollers 21, 22 and 24. The bottom belt 30 is particularly visible in FIG. 1 and runs around deflection roller 31, for example The conveyor elements designated 10 through 13 belong to the free wheeling section, and those designated 20 through 24 to the cover belt section. The arriving letters 1 are transported upright, e.g., as shown in FIG. 1, and generally change their direction of transport in the vertical plane, as can be seen in FIG. 1. In passing over to the cover belt section, the letters are straightened with respect to their lower lengthwise edge in the free wheeling section.

In the letter dislocation zone, there is a guide plate 41 and 42 at either side, between the side belts 10 and 13 and the bottom belt 30. The guide plates are configured such that their lower end terminates just above the bottom belt 30 and their opposite end extends up to or beyond the upper edge of the side belt.

Figure 3:
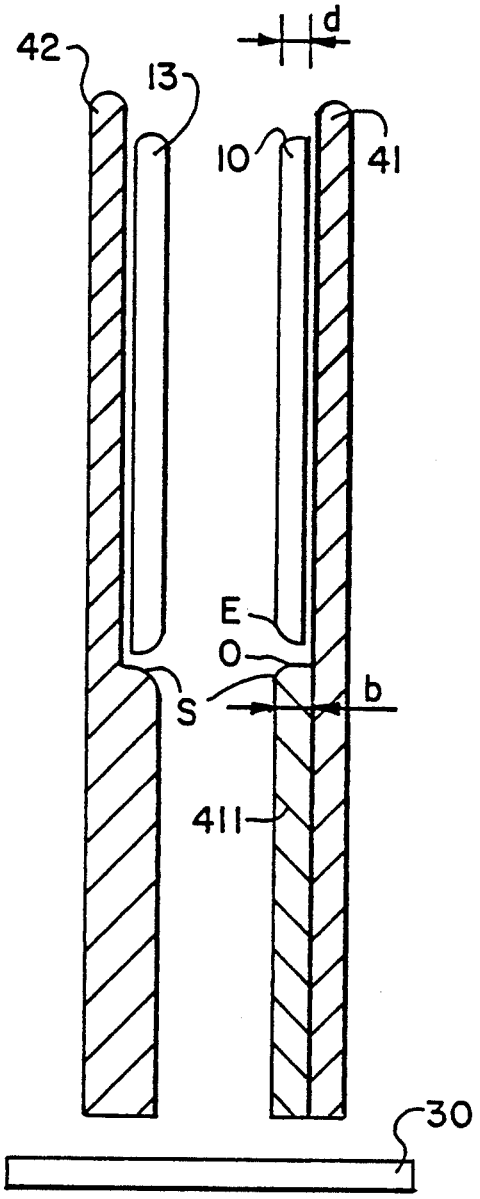
FIG. 3 is a section taken along the line B—B of FIG. 1.
Figure 4:
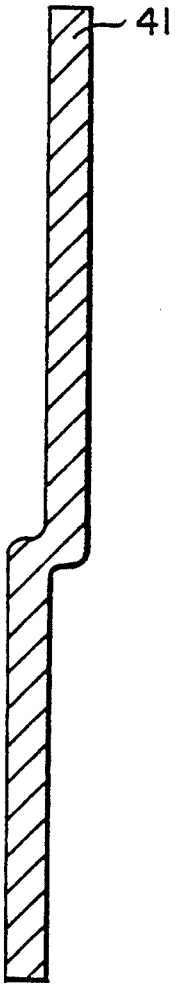
FIG. 4 is a cross sectional view of another embodiment of guide plate.

FIG. 3 shows the guide plates 41 and 41 as an enlarged section taken along line B—B of FIG. 1. As is apparent from FIGS. 1 and 3, each guide plate 41 or 42 has a step S, extending parallel to the direction of transport of the free wheeling section, with a width b equalling the thickness d of a side belt. The lower edge E of the side belt 10, e.g., and the upper edge O of the step S of the guide plate 41 is in the recommended version rounded at the transition. The cross section of guide plate 41 or 42 is shown in two different versions, by way of example, in FIG. 3. In the case of guide plate 41, the step S is produced by an attached plate 411. This step S can also be fashioned by profile milling, as shown in guide plate 42 of FIG. 3, or in a simple and material-sparing manner by molding of the guide plates, as shown for guide plate 41 in FIG. 4.

What is claimed is:

1. A device for straightening and feeding articles such as a letter in a mail handling station, comprising a bottom endless conveyor having an upper reach over which the articles are moveable, a free wheeling conveyor section adjacent said bottom endless conveyor comprising a pair of conveyor belts arranged side by side and between which the article is supported and being moveable through a substantially vertical plane which extends toward said bottom conveyor, a guide plate behind each conveyor belt having a lower portion of a configuration and position such that it extends substantially up to the adjacent conveyor belt, and parallel to the direction of movement of said free wheeling conveyor section, said guide plate having a width substantially equal to the thickness of the associated conveyor belt.

2. A device according to claim 1 wherein each of said plates includes a transition portion forming a step having a width substantially equal to the thickness of said conveyor belt, and wherein said step and the bottom of said conveyor belts are rounded.

3. A device according to claim 2 wherein said guide plates each include an upper and a lower portion, said lower portion being of a greater thickness then said upper portion and forming a step extending below an associated conveyor belt.

4. A device according to claim 1 wherein said guide plate comprises a plate member having an offset lower portion extending from the upper portion inwardly toward said belt and forming a step underlying an associated one of said belts.

* * * * *